US007735825B2

(12) United States Patent
Seike et al.

(10) Patent No.: US 7,735,825 B2
(45) Date of Patent: Jun. 15, 2010

(54) ORIGINAL FEEDING DEVICE

(75) Inventors: Toshihiko Seike, Nara (JP); Hideshi Izumi, Nara (JP); Takashi Makiura, Nara (JP); Yu-hi Akagawa, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 320 days.

(21) Appl. No.: 11/532,137

(22) Filed: Sep. 15, 2006

(65) Prior Publication Data

US 2007/0063420 A1 Mar. 22, 2007

(30) Foreign Application Priority Data

Sep. 21, 2005 (JP) ..... 2005-274221

(51) Int. Cl.
*B65H 9/04* (2006.01)

(52) U.S. Cl. ..... 271/253; 271/229; 271/254; 271/227

(58) Field of Classification Search ..... 271/3.01, 271/3.02, 3.08, 3.14, 4.01, 145, 227, 229, 271/253, 254; 399/367, 372
See application file for complete search history.

(56) References Cited

U.S. PATENT DOCUMENTS 5,288,064 A * 2/1994 Manabe et al. ..... 271/3.08
5,971,388 A * 10/1999 Hattori et al. ..... 271/10.03
6,059,285 A * 5/2000 Suga et al. ..... 271/228
6,151,478 A * 11/2000 Katsuta et al. ..... 399/372

FOREIGN PATENT DOCUMENTS

| | | |
|---|---|---|
| JP | 07-061628 | 3/1995 |
| JP | 08-282880 | 10/1996 |
| JP | 11-079435 | 3/1999 |
| JP | 11079435 A * | 3/1999 |
| JP | 2002-255371 | 9/2002 |

* cited by examiner

*Primary Examiner*—Patrick Mackey
*Assistant Examiner*—Ernesto Suarez
(74) *Attorney, Agent, or Firm*—Renner, Otto, Boisselle & Sklar, LLP

(57) ABSTRACT

In one embodiment of the original feeding device of the present invention, an original feeding device causes a drawing roller to contact an original, and draws the original for forwarding by rotating the drawing roller, and is provided with an original pressing member that generates frictional force on the original surface at a position on the side further upstream in a forwarding direction of the original than the drawing roller.

6 Claims, 15 Drawing Sheets

ORIGINAL FEEDING DEVICE

BACKGROUND OF THE INVENTION

This application claims priority under 35 U.S.C. §119(a) on Patent Application No. 2005-274221 filed in Japan on Sep. 21, 2005, the entire contents of which are hereby incorporated by reference.

The present invention relates to original feeding devices that are provided in copying machines, fax machines or the like that perform capturing to copy or transmit an original, and draw an original out of an original tray to forward the same.

In devices of this type, when an original P is placed on an original tray 101 as illustrated in FIGS. 16 and 17, a drawing roller 102 is caused to contact the proximity of the leading edge of the original P, and is rotated so as to draw the original P for forwarding the same. The original P is transported to PS rollers 104 via separating rollers 103 for separating originals one by one, and is transported through the PS rollers 104 to a scanner (not shown). The scanner captures an image of the original.

As illustrated by the dashed line in FIG. 17, when the original P drawn by the drawing roller 102 is transported at a slant to the scanner and captured, the image of the original P is captured at a slant. Therefore, the leading edge of the original P is abutted against the PS rollers 104 for alignment, before being transported to the scanner.

However, in a case where the original P is slanted significantly when the original P is drawn by the drawing roller 102, it becomes impossible to align the leading edge of the original P parallel to the PS rollers 104 merely by abutting the original P against the PS rollers 104.

Even if the leading edge of the original P could be aligned parallel to the PS rollers 104 by being abutted against the PS rollers 104, the direction of the original P has been changed and a center line p1 of the original P is displaced from a capturing center s1 of the original by the scanner, as shown in FIG. 18. Even a slight amount of such displacement makes it impossible for the scanner to capture the edge portions of the original. Therefore, an original with no margin at the edges cannot be captured accurately.

For this reason, a pair of guide plates 105 for guiding the original are provided in the original tray 101 so as to prevent slanted transport of the original. In addition, each guide plate 105 is arranged in a manner that the pair of guide 105 plates can be shifted symmetrically with respect to the capturing center of the original. The distance between the guide plates 105 is adjusted according to the width of the original so as to guide originals with various widths with the guide plates 105 without displacing the capturing center of the original.

JP H11-79435A (hereinafter referred to as "Patent Document 1") discloses technology in which a pair of ancillary rollers are provided at both ends of the drawing roller (referred to as the "forwarding roller" in the Patent Document 1) on the side further upstream in the original forwarding direction than the drawing roller, and causes the ancillary rollers to press the original together with the drawing roller in order to prevent slanted transport of the original.

JP H8-282880A (hereinafter referred to as "Patent Document 2") discloses technology in which a pressure roller is arranged on the side further upstream in the original forwarding direction than the drawing roller (referred to as the "transport roller" in the Patent Document 2), and causes the pressure roller to press the original together with the drawing roller in order to prevent slanted transport of the original.

However, even if a pair of guide plates 105 are provided as illustrated in FIG. 17, in a case where the widths of a plurality of sheets of originals placed between the guide plates 105 are different from one another, only the original with the greatest width is guided by the guide plates 105, and other originals with smaller widths are not guided by the guide plates 105. Consequently, the originals with smaller widths are transported at a slant.

Generally, originals of the same size are transported for capturing, and therefore, all originals are appropriately guided by the guide plates 105. However, a use condition is also possible in which a plurality of originals with different widths are captured in a mixed state. In such a case, even if these originals are placed on the original tray, not all the originals are guided by the guide plates 105, and the originals with smaller widths are transported at a slant, resulting in defective capturing.

In addition, when ancillary rollers are provided as in Patent Document 1 and Patent Document 2, the mechanism itself becomes complicated, often inviting an increase in size, and also the mechanism for interlocking ancillary rollers with the drawing roller increases in size.

Furthermore, in the method of pressing the ancillary rollers against the original as described in Patent Document 1, a plurality of locations on the original are pressed by the drawing roller and the ancillary rollers to prevent slanted transport of the original. However, even if the original is pressed by the rollers, the direction of the original easily changes during rotation of the rollers. As a result, sufficient braking force for resisting the rotation moment of the original cannot be generated, and therefore substantial effects cannot be expected. Increasing the pressure of the ancillary rollers against the original to improve the braking force makes transport of the original itself difficult. Adjustment of the pressure of the ancillary rollers is difficult even with these measures. Consequently, adequate effects cannot be achieved.

As described above, with the conventional technology, it has been impossible to concurrently achieve both generating sufficient braking force that resists the rotation moment of the original and smooth transport of the original.

SUMMARY OF THE INVENTION

The present invention was made in view of these problems, and it is an object thereof to provide an original feeding device with which downsizing is easy due to a simple structure, and that is capable of effectively suppressing slanted transport of an original.

In order to solve the above problems, an original feeding device of the present invention causes a drawing roller to contact an original and draw the original for forwarding by rotating the drawing roller, wherein the original feeding device is provided with an original pressing member for generating frictional force on the original surface at a location on the side further upstream in a forwarding direction of the original than the drawing roller.

When the drawing roller contacts the original on the center line of the original, drawing force of the drawing roller is applied along the center line of the original, so that no moment is generated around the center of gravity on the center line of the original. However, when the drawing roller contacts the original at a position displaced from the center line of the original, drawing force of the drawing roller is applied to the position displaced from the center line of the original, and moment is generated around the center of gravity on the center line of the original. As a result, the original is transported at a slant.

In the original feeding device of the present invention, the original pressing member generates frictional force with respect to the original surface at a position on the side further upstream in the original forwarding direction than the drawing roller. That is, the original pressing member generates frictional force with respect to the original surface around the center of gravity of the original, which is located on the side further upstream than a position on the original to which drawing force of the drawing roller is applied. With this configuration, regardless of the width or size of the original, when the moment generated around the center of gravity of the original acts on the original, frictional force between the original pressing member and the original surface, namely, sliding frictional force, serves as significant braking force for resisting the moment, and slanted transport of the original can be suppressed.

In the present invention, the original pressing member may include a weight for pressing the original surface. In this way, even if the number of sheets of originals becomes large and the position of the original pressing member for pressing on top of the originals becomes high, it is possible to press originals with constant force with the original pressing member, and maintain an appropriate level of frictional force between the original pressing member and the original surface.

In the present invention, the original pressing member may include a friction member that contacts the original surface and generates frictional force. In this way, frictional force between the original pressing member and the original surface can be reliably generated.

In the present invention, the original pressing member may be provided with a lifting mechanism for lifting up/lowering down the drawing roller with respect to the original, and the lifting mechanism may lift up/lower down the original pressing member in conjunction with lifting up/lowering down of the drawing roller, and the original may be pressed against or released from such pressing by the original pressing member. Since the original pressing member presses an original after the original is placed, it is preferable that the original pressing member is lifted up before the original is placed to provide space for placing the original. In other words, the drawing roller is lifted up before the original is placed. After the original is placed, the drawing roller is lowered down and brought into contact with the original. By lifting up/lowering down the original pressing member interlocked with the drawing roller, the original pressing member can be automatically lifted up/lowered down.

In the present invention, the original pressing member may move in a direction perpendicular to the forwarding direction of the original. The magnitude of the moment of an original changes in accordance with the original size, the contact state of the drawing roller with the original, or the like. Therefore, by changing the position at which frictional force between the original pressing member and the original surface is generated by enabling the original pressing member to move in a direction perpendicular to the original forwarding direction, braking force for resisting the moment of the original can be adjusted.

In the present invention, the original feeding device may include a moving means for moving, in a direction perpendicular to the forwarding direction of the original, a pressing position where the original pressing member presses on the original surface, a slanted transport detecting means for detecting slanted transport of the original forwarded by the drawing roller, and a control unit that moves and adjusts the pressing position where the original pressing member presses on the original surface with the moving means when the slanted transport detecting means detects slanted transport of the original. With this configuration, by moving the original pressing member in a direction perpendicular to the original forwarding direction, it is possible to change the position at which frictional force between the original pressing member and the original surface is generated and adjust braking force for resisting the moment of the original. Consequently, slanted transport of the original can be controlled. Specifically, with this configuration, slanted transport of the original can be precisely corrected by detecting slanting of the original and moving the pressing position on the original surface with the original pressing member in accordance with the slanting.

In the present invention, the original feeding device may include a separating roller for separating originals forwarded by the drawing roller one by one, and the distance from the pressing position where the original pressing member presses on the original surface to the trailing edge of an original of the smallest size may be longer than the distance from the drawing roller to the separating roller. The separating rollers are located on the side further downstream than the drawing roller. When the original is sandwiched by the separating rollers following the drawing roller, the slant amount of the original does not change any more, which makes it unnecessary to press the original with the original pressing member. Accordingly, it is necessary that the original pressing member keeps pressing the original until the original is sandwiched by the separating rollers. In this configuration, for this purpose, the distance between the pressing position on the original surface with the original pressing member and the trailing edge of the original with the smallest size is set longer than the distance between the drawing roller and the separating rollers.

DESCRIPTION OF THE PREFERRED EMBODIMENTS

Hereinafter, preferred embodiments of the present invention will be described with reference to the accompanying drawings.

Embodiment 1

Figure 1:
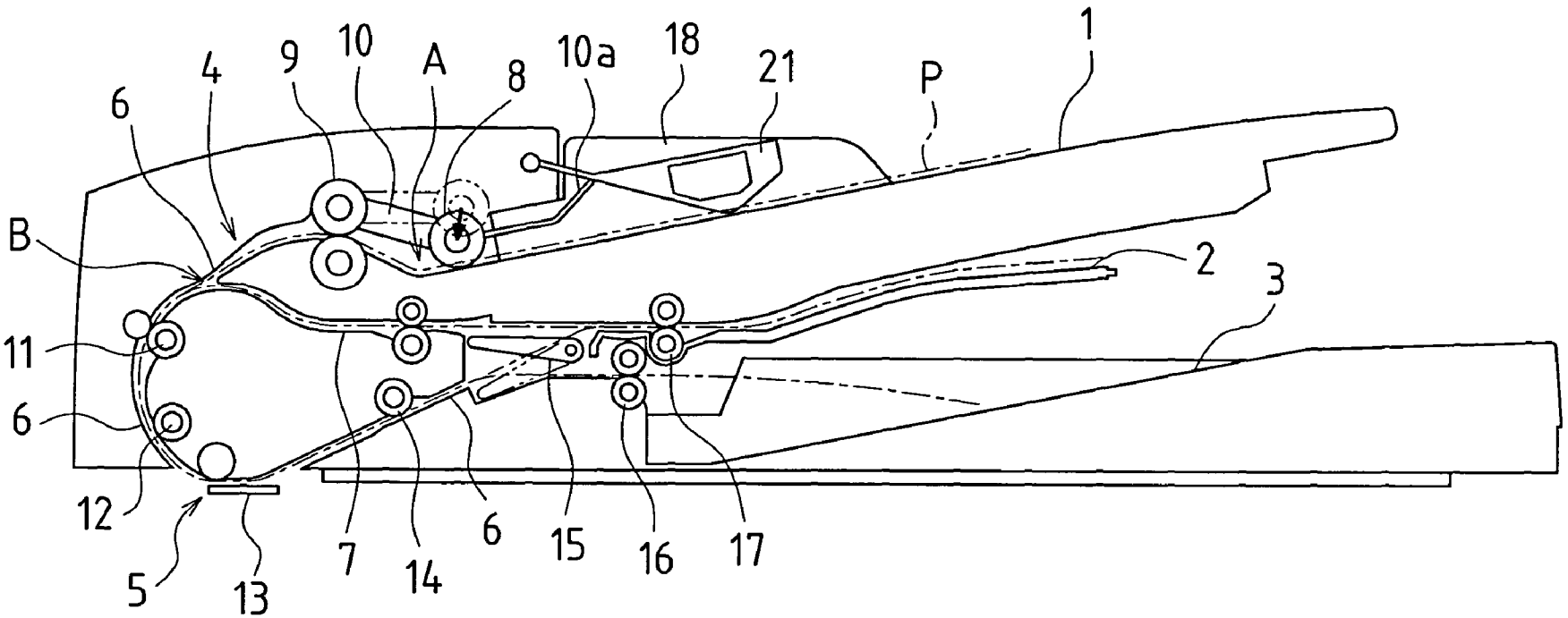
FIG. 1 is a cross-sectional view of an original feeding device according to Embodiment 1 of the present invention as viewed from the side.
Figure 2:
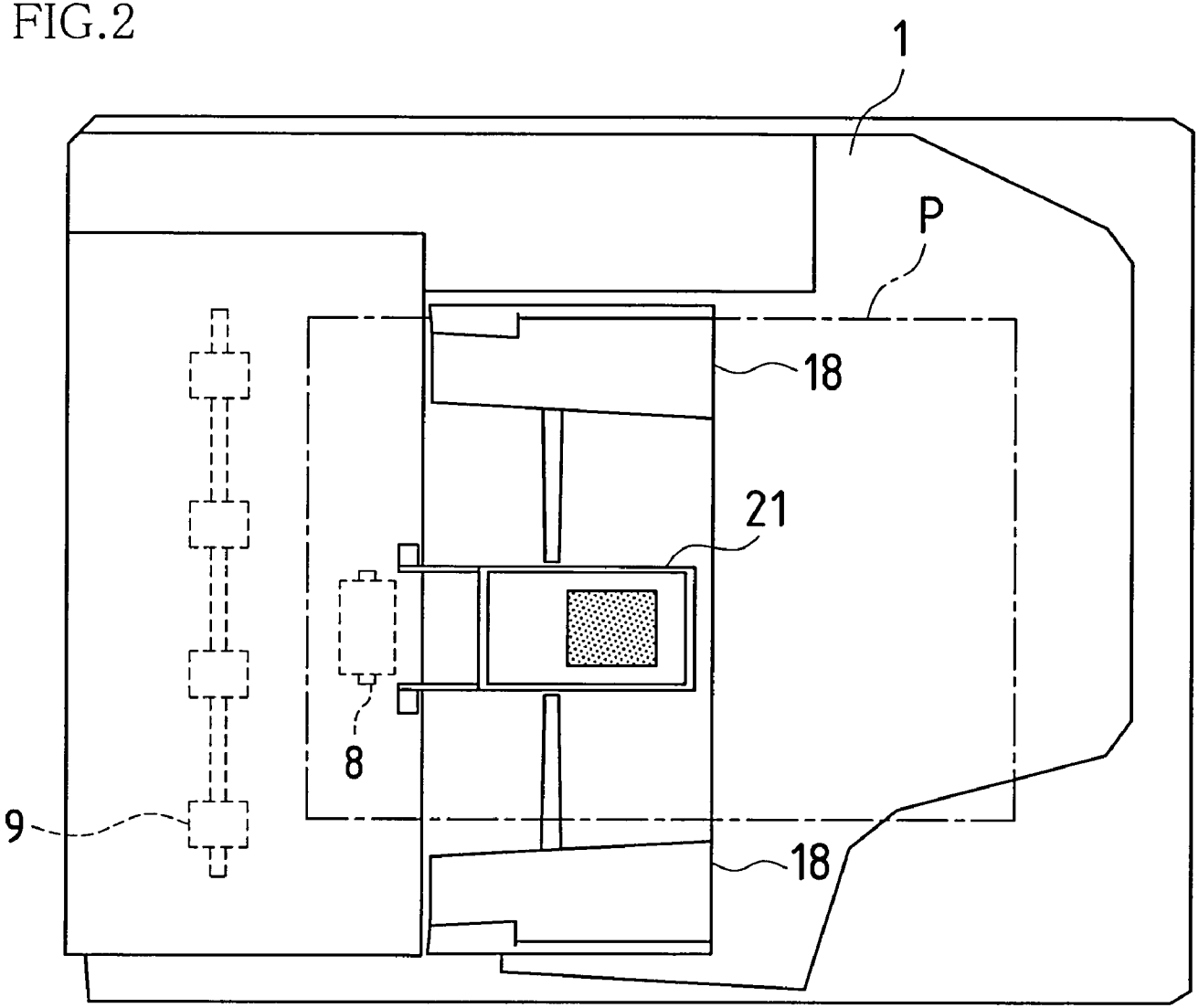
FIG. 2 is a top view showing the original feeding device of FIG. 1.

FIG. 1 is a cross-sectional view of an original feeding device according to Embodiment 1 of the present invention as viewed from the side. FIG. 2 is a top view showing the original feeding device of Embodiment 1. The original feeding device of Embodiment 1 is adopted in, for example, copying machines that capture originals for copying, and draws an original from an original tray 1 and forwards this original to an original capturing position 5 where an original is captured by a scanner (not shown).

The original feeding device is provided with an original tray 1 on which an original is placed, a middle tray 2, an original discharge tray 3 for discharging the original, and an original transport mechanism 4 for transporting the original among the trays 1, 2 and 3.

The original transport mechanism 4 includes a main transport path 6 for transporting the original placed on the original tray 1 to the middle tray 2 or the original discharge tray 3 via the original capturing position 5, and a sub transport path 7 for supplying the original on the middle tray 2 back to the main transport path 6.

Figure 3:
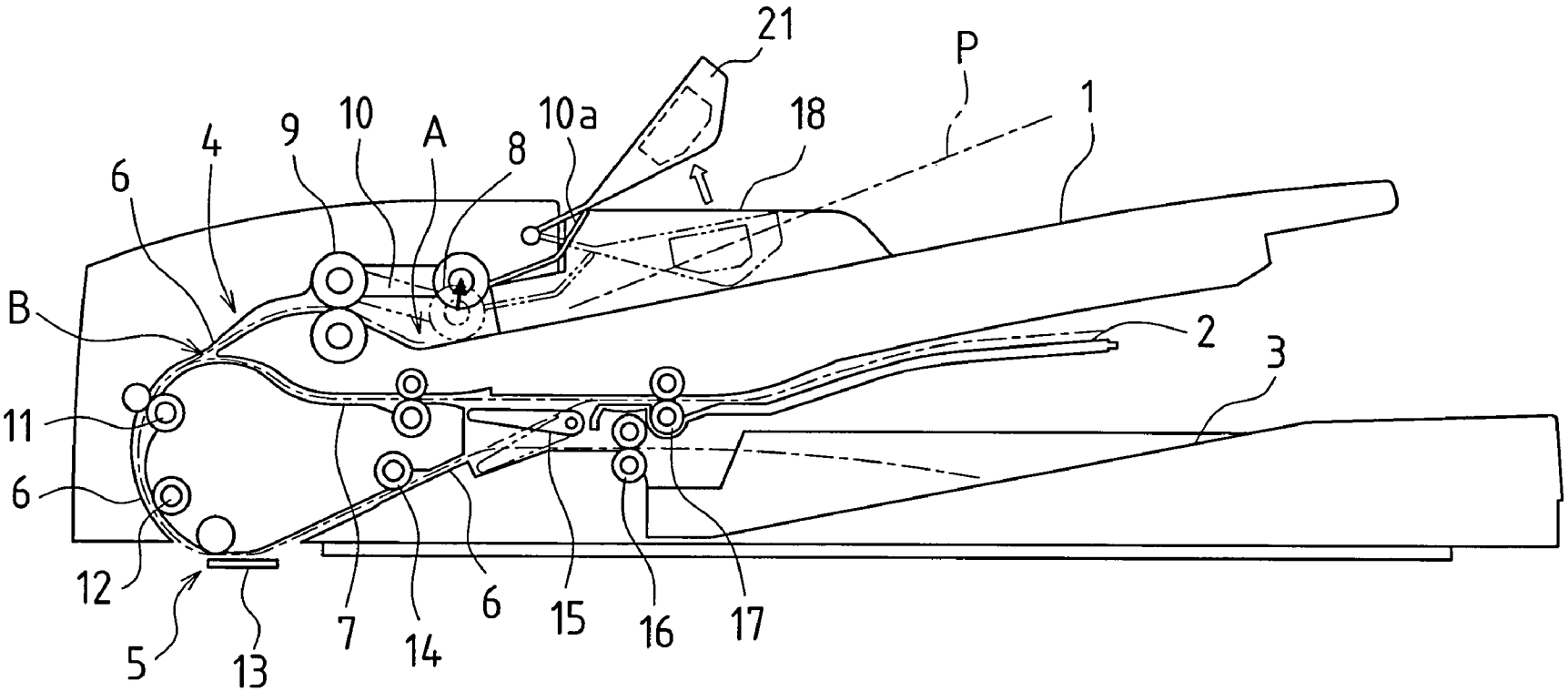
FIG. 3 is a lateral view showing a state in which a drawing roller and an original pressing member are lifted up in the original feeding device of FIG. 1.

On the side of the main transport path 6 (a portion opposing the discharge side of the original tray 1) on the upstream end, a drawing roller 8 and a pair of separating rollers 9 are disposed. The drawing roller 8 is supported by a shaft at the front end of an interlocking arm 10 as illustrated in FIGS. 1 and 3. The interlocking arm 10 is supported by a shaft such that it can rotate with respect to the shaft of the separating rollers 9. In this way, the drawing roller 8 is supported such that it can rotate, with the shaft of the separating rollers 9 used as the center of rotation, which allows lifting up/lowering down the drawing roller 8. Before the original is placed on the original tray 1, the drawing roller 8 is lifted up, and the original is placed on the original tray 1 in such a state. The leading edge of the original slides in between the original tray 1 and the drawing roller 8, and reaches a position A. Thereafter, when the drawing roller 8 is lowered down as illustrated in FIG. 1, the drawing roller 8 contacts the proximity of the leading edge of the original. When the drawing roller 8 is rotated, the original on the original tray 1 is drawn by the drawing roller 8, and the original is transported passing between the separating rollers 9.

A pair of PS rollers 11 and a transport roller 12 are provided on the side further downstream than a linking location B of the main transport path 6 and the sub transport path 7. On the side still further downstream, a glass platen 13 of an original capturing device (not shown) is provided. Below this glass platen 13, a scanner for capturing an image of the original (not shown) is provided. Rotation of the PS rollers 11 is temporarily stopped, and the leading edge of the original that has passed between the separating rollers 9 abuts against the PS rollers 11, so that the leading edge of the original is aligned parallel to the PS rollers 11. The PS roller 11 starts rotating to transport the original at a timing such that the leading edge of the original reaches the glass platen 13 when a scanner (not shown) starts capturing.

Through the glass platen 13, the scanner illuminates the original transported in the sub-scanning direction on the glass platen 13, and repeatedly captures the original image in the main-scanning direction, thereby capturing an entire image of the original.

On the downstream side of the glass platen 13, a transport roller 14 and a swinging plate 15 are disposed. On the side further downstream than the swinging plate 15 in the main transport path 6, a pair of original discharge rollers 16 and the original discharge tray 3 are provided. On the side further downstream than the swinging plate 15 in the sub transport path 7, a pair of transport rollers 17 and the middle tray 2 are provided. The original that has passed above the glass platen 13 is discharged to the original discharge tray 3 through the transport roller 14, swinging plate 15 and original discharge rollers 16, or transported to the middle tray 2 through the transport roller 14, swinging plate 15 and transport rollers 17.

The swinging plate 15 swings in the vertical direction and switches the paths to guide the original that has passed above the glass platen 13 to either the original discharge tray 3 or the middle tray 2. When the original is guided to the original discharge tray 3 side by the swinging plate 15, the original is discharged to the original discharge tray 3 through the original discharge rollers 16. When the original is guided to the middle tray 2 side by the swinging plate 15, the original is transported to the middle tray 2 through the transport rollers 17, and the leading edge side of the original is placed on the middle tray 2. When the trailing edge of the original is sandwiched between the transport rollers 17, the transport rollers 17 stop rotation and then are driven to rotate in a reverse direction, so that the original is transported to the sub transport path 7 via the swinging plate 15. The original is further transported from the sub transport path 7 to the main transport path 6, and the front and back surfaces of the original are reversed. After the leading edge of the original is aligned parallel to the PS rollers 11, the original passes above the glass platen 13, the image on the back surface thereof is captured, and the original is discharged to the original discharge tray 3 through the original discharge rollers 16.

In such an original feeding device, after the leading edge of the original is aligned parallel to the PS rollers 11, the original is transported to the glass platen 13, and the scanner captures the image of the original. This prevents the original image from being captured at a slant.

Figure 18:
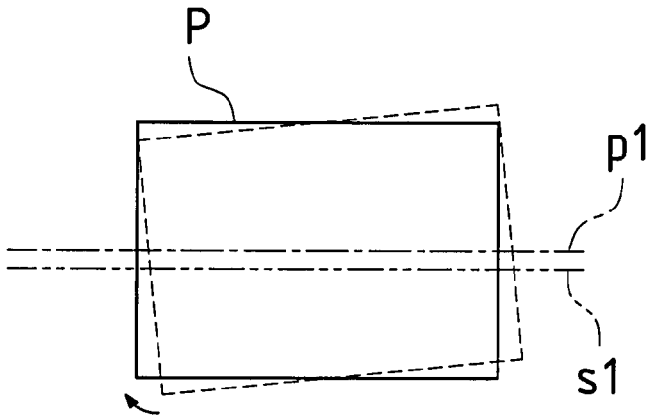
FIG.18 Prior Art
FIG. 18 is a diagram explaining decentering of the original.

However, in a case where the original is slanted significantly when the original is drawn by the drawing roller 8, it becomes impossible to align the leading edge of the original parallel to the PS rollers 11 merely by abutting the original against the PS rollers 11. Even if the leading edge of the original could be aligned parallel to the PS rollers 11 by being abutted against the PS rollers 11, the center line p1 of the original P is displaced from the capturing center s1 of the original by the scanner, as illustrated in FIG. 18.

For this reason, in this original feeding device, a pair of guide plates 18 for guiding an original are provided in the original tray 1. These guide plates 18 guide the original and prevent slanted transport of the original. The guide plates 18 are supported allowing them to shift in a direction perpendicular to the original forwarding direction. The guide plates 18 are interlocked via a transmission mechanism (not shown) such as a rack-and-pinion gear so that the guide plates 18 shift symmetrically with respect to the capturing center of the original. In this way, the distance between the guide plates 18 can be adjusted according to the width of the original, and originals with various widths can be guided by the guide plates 18 without displacing the capturing center of the original.

Figure 4A:
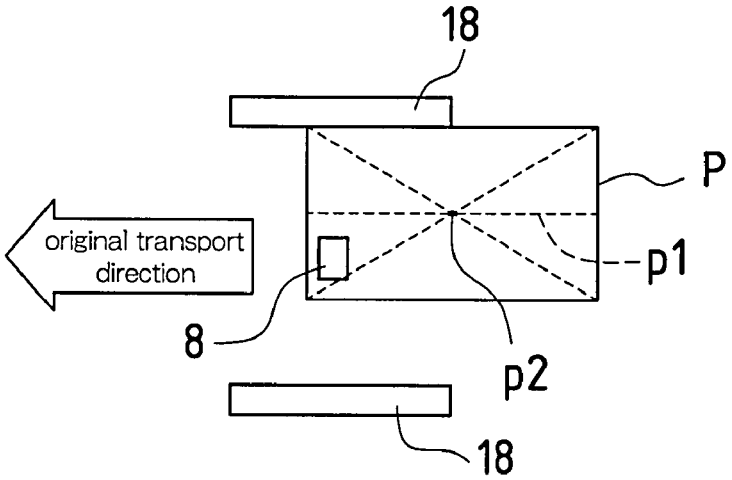
FIGS. 4A, 4B, 4C and 4D are diagrams for explaining how slanted transport of the original occurs and the effects of suppressing slanted transport of the original.
Figure 4B:
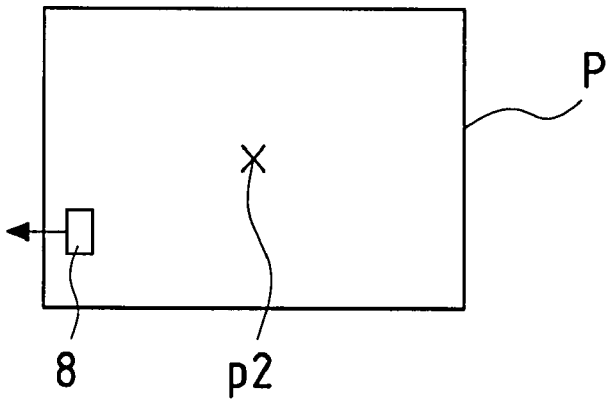
Figure 4C:
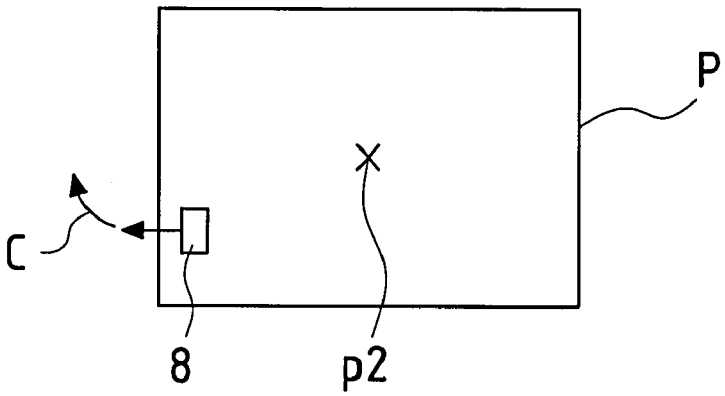

However, if the widths of a plurality of sheets of originals placed between the guide plates 18 are different from one another, only the original with the greatest width is guided by the guide plates 18 and originals with smaller widths are not guided, and consequently the originals with smaller widths are transported at a slant. For example, as illustrated in FIGS. 4A and 4B, in a state in which an original P with a small width is placed abutted against one of the guide plates 18 and separated from the other guide plate 18, the drawing roller 8 contacts the original P at a position displaced from the center line p1 of the original P, drawing force of the drawing roller 8 is applied to a position displaced from the center line p1 of the original P, and moment is generated around a center of gravity p2 on the center line p1 of the original P. As a result, the original P is transported slanted in the direction of arrow C as shown in FIG. 4C.

Accordingly, in the present embodiment, an original pressing member 21 is provided on the side further downstream in the original forwarding direction than the drawing roller 8. The original pressing member 21 presses an original on the original tray 1 to generate frictional force between the original pressing member 21 and the original, and thereby prevents slanted transport of the original. As a result, with respect to even an original with a width smaller than the distance between the guide plates 18, in other words, an original with a small width that cannot be guided precisely by the guide plates 18, by placing such an original on the original tray 1 so as to be pressed against by the original pressing member 21, slanted transport of the original can be prevented.

Figure 5A:
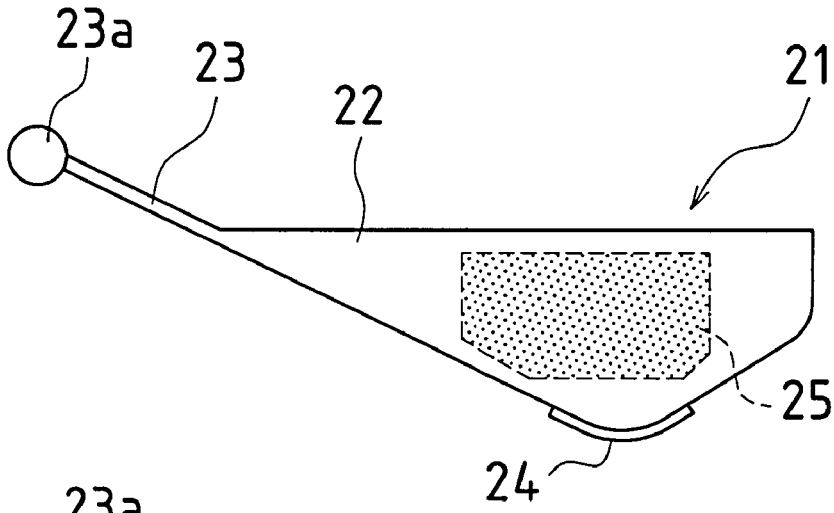
FIG. 5A is a lateral view of the original pressing member of the original feeding device of FIG. 1.
Figure 5B:
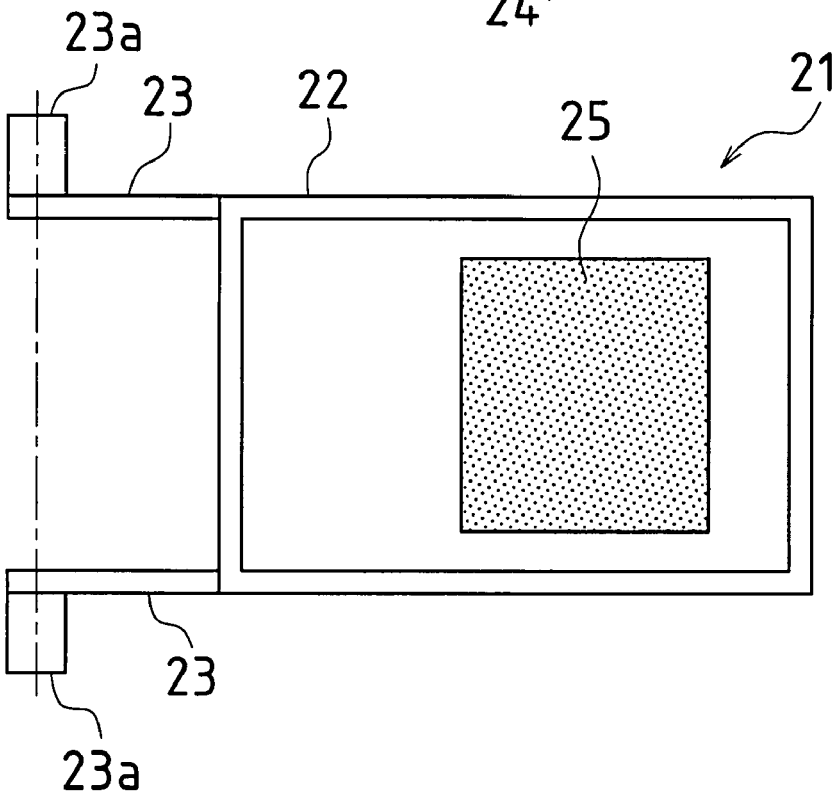
FIG. 5B is a top view thereof.

FIGS. 5A and 5B are, respectively, a lateral view and top view showing the original pressing member 21. As shown clearly in FIGS. 5A and 5B, the original pressing member 21 includes a hollow main body 22, a pair of arms 23 that protrude from one side of the main body 22, a friction member 24 attached to the exterior base surface of the main body 22, and a weight 25 that is disposed fixed in the main body 22.

The main body 22 is a housing whose top is open and has a rectangular shape when viewed from the top. The weight 25 is fixed inside the housing. The bottom of the main body 22 has the shape of a mound when viewed from the side. The friction member 24 is attached to the top of the mound.

The pair of arms 23 protrude from one side of the main body 22, and have shaft portions 23*a* that extend towards both outer sides from the respective ends of the arms 23. The shaft portions 23*a* of the arms 23 are joined to concave portions (not shown) of the original feeding device main body at the discharge side of the original tray 1, and rotatably supported. Accordingly, the original pressing member 21 is supported rotatably around the shaft portions 23*a* of the arms 23, which enables lifting up/lowering down the main body 22 of the original pressing member 21.

As shown in FIGS. 1 and 3, a pushing-up arm 10*a* is interlocked and fixed to the interlocking arm 10 that supports the drawing roller 8 allowing for lifting up/lowering down of the drawing roller 8, and the pushing-up arm 10*a* is lifted up/lowered down in conjunction with the interlocking arm 10 and the drawing roller 8. The front end of this pushing-up arm 10*a* is abutted against the bottom side of the arms 23 of the original pressing member 21. When the interlocking arm 10 and the drawing roller 8 are lifted up, the pushing-up arm 10*a* also rotationally moves upward, and thereby the front end of the pushing-up arm 10*a* pushes up the original pressing member 21. In this state, the leading edge of the original can be slid between the original tray 1 and the original pressing member 21 as well as the drawing roller 8, and the original pressing member 21 does not disturb placement of the original on the original tray 1. When the interlocking arm 10 and the drawing roller 8 are lowered down, the pushing-up arm 10*a* also rotationally moves downward, and the original pressing member 21 is also lowered down. Consequently, the original pressing member 21 presses the original on the original tray 1 and frictional force is generated between the original pressing member 21 and the original.

Figure 4D:
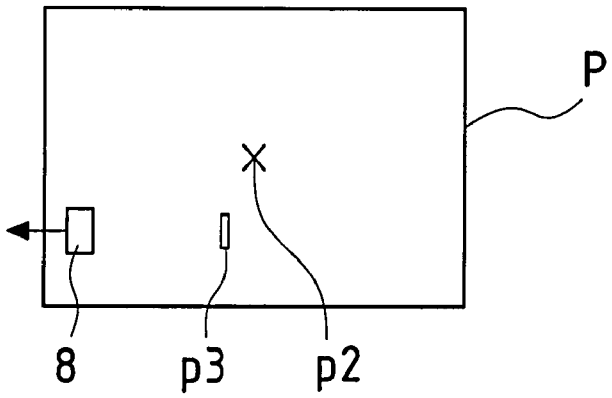

A state is assumed in which, as shown in FIGS. 4A and 4B, an original P with a small width is placed abutted against one of the guide plates 18, the drawing roller 8 contacts the original P at a position displaced from the center line p1 of the original P, and drawing force of the drawing roller 8 is applied to a position displaced from the center line p1 of the original P. At this time, if the original pressing member 21 presses the original P at a position p3 on the upstream side of the drawing roller 8 as shown in FIG. 4D, frictional force is generated at the position p3 between the original pressing member 21 and the original P. The position p3 at which the frictional force is generated is located around the center of gravity p2 of the original P, and therefore the frictional force serves as braking force for resisting the moment around the center of gravity p2 of the original P and suppresses slanted transport of the original P. Since this frictional force is sliding frictional force generated between the frictional member 24 of the original pressing member 21 and the original P, it provides sufficient braking force. Further, since the contact region between the friction member 24 of the original pressing member 21 and the original P has a shape elongated in a direction perpendicular to the original transport direction, braking force for resisting the moment around the center of gravity p2 of the original P can be effectively generated.

In the case of an original that abuts both guide plates 18, the drawing roller 8 contacts the original on its center line, the drawing force of the drawing roller 8 is applied along the center line of the original, and moment does not occur around the center of gravity on the center line of the original.

Figure 6:
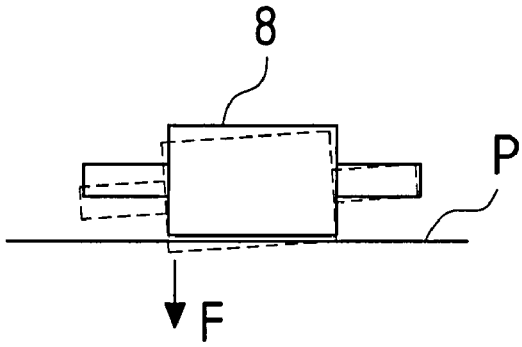
FIG. 6 is a diagram for explaining force of the drawing roller unevenly applied to the original.

Slanted transport of the original P occurs not only when the drawing roller 8 contacts the original P at a position displaced from the center line p1 of the original P, but also when pressure F of the drawing roller 8 that acts on the original P is shifted to the right or left as shown in FIG. 6. In such a case as well, slanted transport of the original P is effectively suppressed by the original pressing member 21.

In such an original feeding device, if the widths of a plurality of sheets of originals are different from one another, the originals are aligned on one side and abutted against one of the guide plates 18. In this way, it is possible to effectively prevent slanted transport even with respect to an original with a small width, since the original pressing member 21 suppresses slanted transport of the original with one side of the original guided by one guide plate 18.

In addition, since the weight 25 is provided in the original pressing member 21, even if the number of sheets of originals becomes large and the position of the original pressing member 21 for pressing on top of the originals becomes high, it is possible to press the originals with constant force with the original pressing member 21, and maintain an appropriate level of frictional force between the original pressing member 21 and the original surface.

Further, since the friction member 24 is provided in the original pressing member 21, sliding frictional force between the original pressing member 21 and the original surface can be reliably generated.

Next, a specific example of the position at which the original pressing member 21 presses the original is described.

Figure 7A:
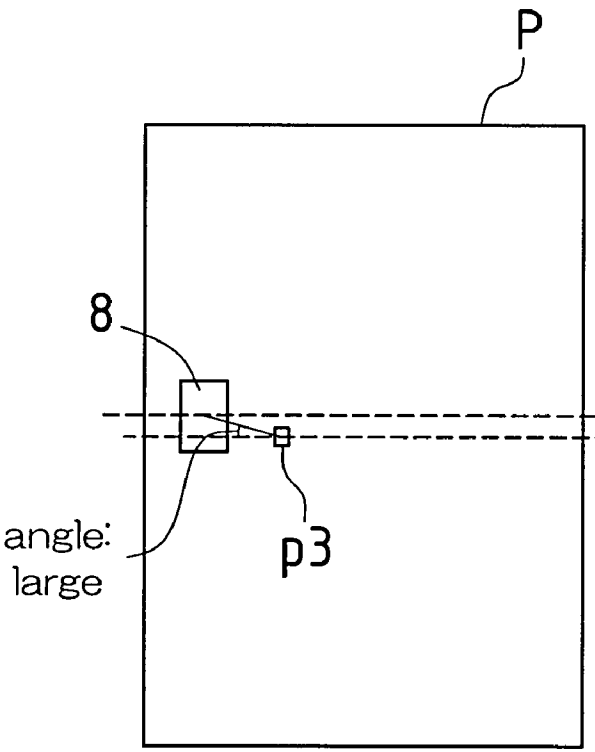
FIGS. 7A and 7B are diagrams illustrating the position to press the original with the original pressing member in the original feeding device of FIG. 1.
Figure 7B:
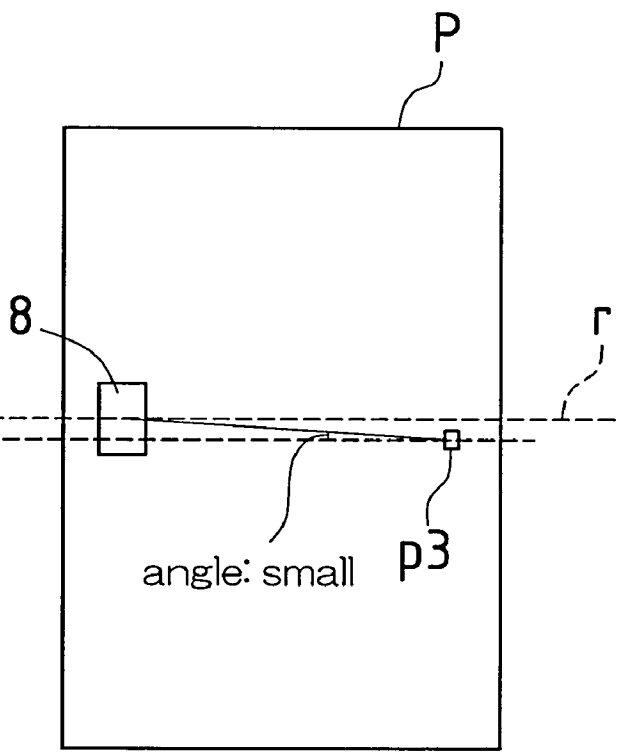
Figure 8:
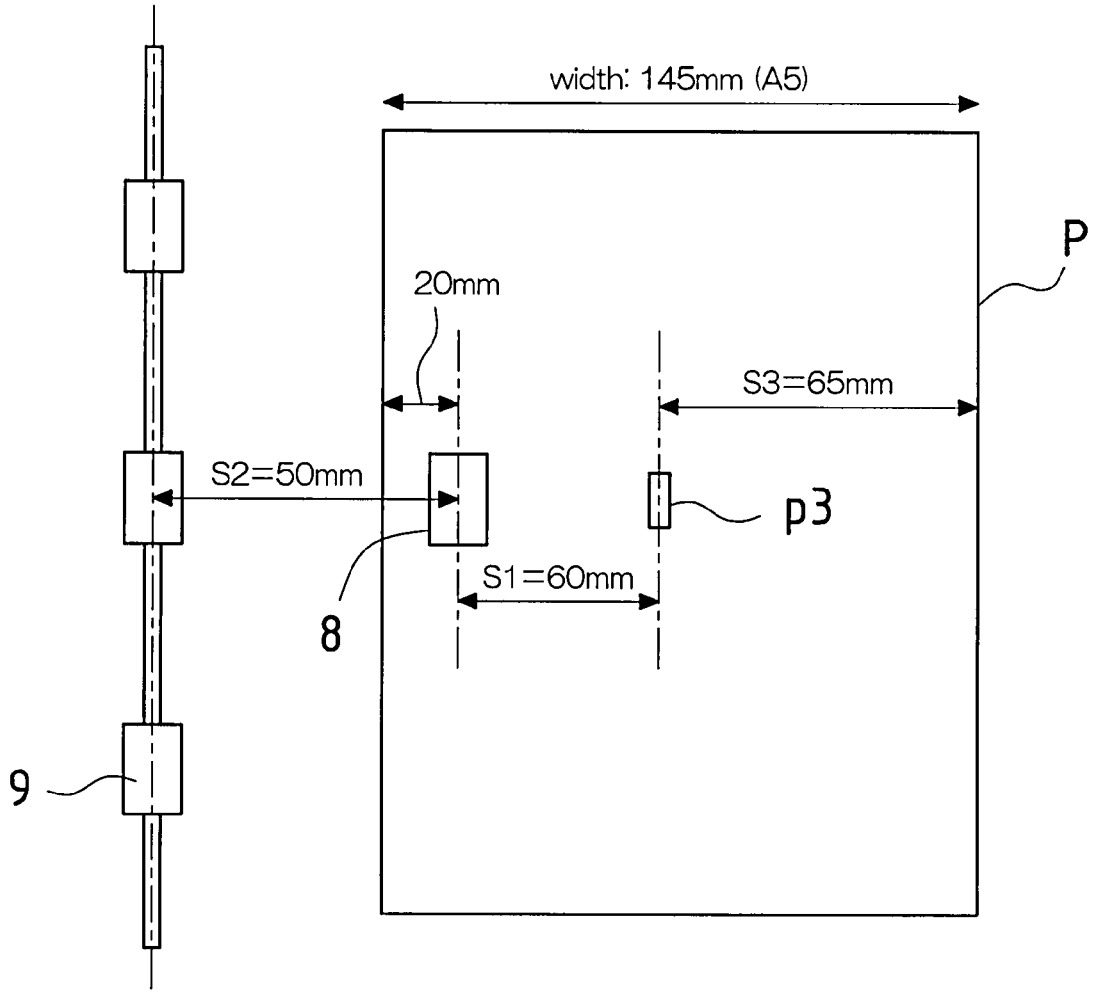
FIG. 8 is a diagram showing a specific example of the position to press the original with the original pressing member in the original feeding device of FIG. 1.

As illustrated in FIGS. 7A and 7B, whether the position p3 at which the original pressing member 21 presses the original P is close to or distant from the drawing roller 8, if the pressing position p3 is displaced from the center r of the drawing roller 8, moment centering on the pressing position p3 is generated on the original P and may cause slanted transport of the original P. This moment centering on the pressing position p3 increases as the position p3 becomes closer to the drawing roller 8, and decreases as the position p3 becomes more distant from the drawing roller 8. Consequently, it is better to place the original pressing member 21 distant from the drawing roller 8.

However, when the original pressing member 21 is placed too distant from the drawing roller 8, the original pressing member 21 disturbs placement of the original on the original tray 1.

In addition, once the original is drawn by the drawing roller 8 and the leading edge of the original is sandwiched between the separating rollers 9, the original is held at two points by the drawing roller 8 and the separating rollers 9, and therefore the slant amount of the original will not increase any more. Accordingly, it is sufficient for the original pressing member 21 to suppress slanted transport of the original just until the leading edge of the original reaches the separating rollers 9. For this purpose, it is sufficient that the distance between the position p3 at which the original pressing member 21 presses the original and the trailing edge of the original of the smallest size is set longer than the distance between the drawing roller 8 and the separating rollers 9. The distance to the trailing edge of the original of the smallest size is a value before the original of the smallest size is forwarded from the original tray 1.

Assuming that the smallest size of the original P is generally A5 size and a distance S2 from the drawing roller 8 to the separating rollers 9 in the original feeding device is 50 mm, based on the width of A5, namely, 145 mm, and the distance S2 (=50 mm), a distance S1 from the position p3 at which the original pressing member 21 presses the original to the drawing roller 8 was set to 60 mm. In this case, a distance S3 from the position p3 for pressing the original P to the trailing edge of the original P is 65 mm, and it is possible to keep pressing the original P with the original pressing member 21 until the leading edge of the original P reaches the separating rollers 9. In addition, the original pressing member 21 does not disturb placement of the original on the original tray 1.

After setting the distance S1 from the position p3 at which the original pressing member 21 presses the original to the drawing roller 8 to 60 mm in this way, the effects of suppressing slanted transport of the original achieved by the original pressing member 21 were confirmed by way of experiment. The results of this experiment are shown in FIGS. 10A to 10E.

Figure 9A:
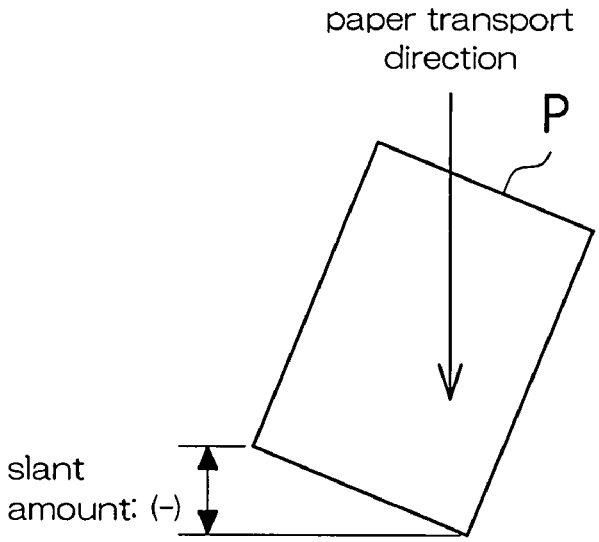
FIGS. 9A and 9B are diagrams for explaining the definition of the slant amount of an original.
Figure 9B:
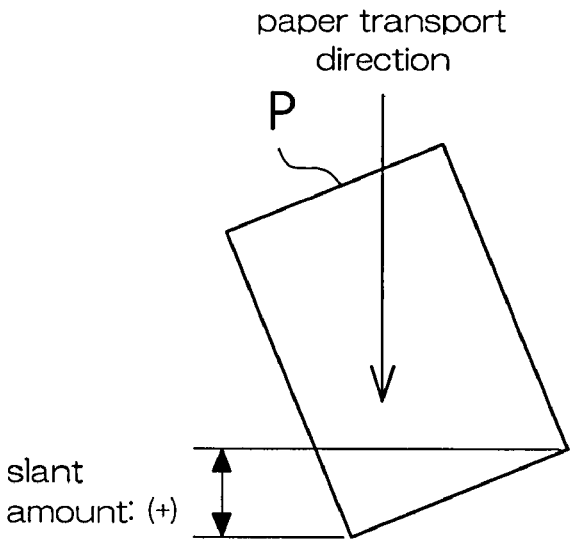

In this experiment, as shown in FIGS. 9A and 9B, the amount of deviation between the right and left corners of an original P that was slanted with respect to the transport direction was measured as a slant amount (mm). The slant amount due to delay in transporting the right corner and the slant amount due to delay in transporting the left corner are distinguished by using plus (+) and minus (−). The slant amount was measured at the upstream and downstream sides of the PS rollers 11. The slant amount measured on the upstream side is referred to as the pre-PS slant amount, and that on the downstream side is referred to as the post-PS slant amount.

Urethane resin was used as the friction member 24, and a weight of 11.8 g was used as the weight 25.

Figure 10A:
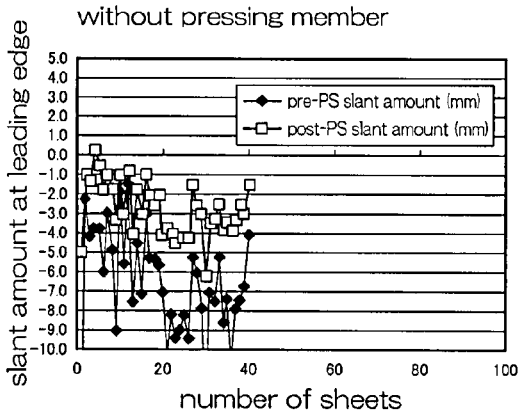
FIGS. 10A, 10B, 10C, 10D and 10E are graphs showing the results of an experiment for confirming the effects of suppressing slanted transport of the original achieved by the original pressing member.

FIG. 10A is a graph showing the measurement results of the pre-PS slant amount and post-PS slant amount obtained when 40 sheets of originals were forwarded from the original tray 1 with the original pressing member 21 removed.

Figure 10B:
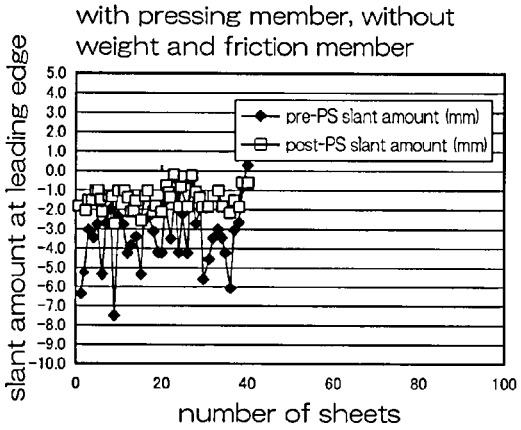

FIG. 10B is a graph showing the measurement results of the pre-PS slant amount and post-PS slant amount obtained when 40 sheets of originals were forwarded from the original tray 1 with the original pressing member 21 attached, and the friction member 24 and the weight 25 omitted.

Figure 10C:
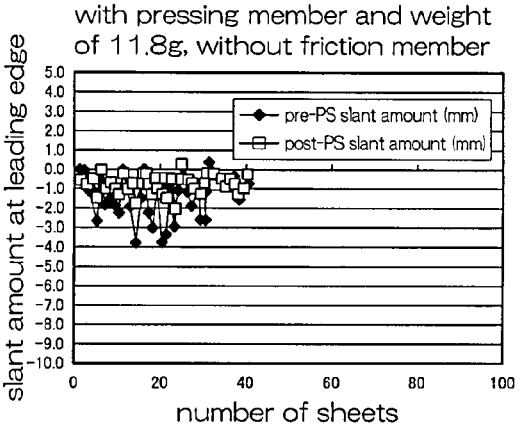

FIG. 10C is a graph showing the measurement results of the pre-PS slant amount and post-PS slant amount obtained with the original pressing member 21 attached, and only the weight 25 added and the friction member 24 omitted.

Figure 10D:
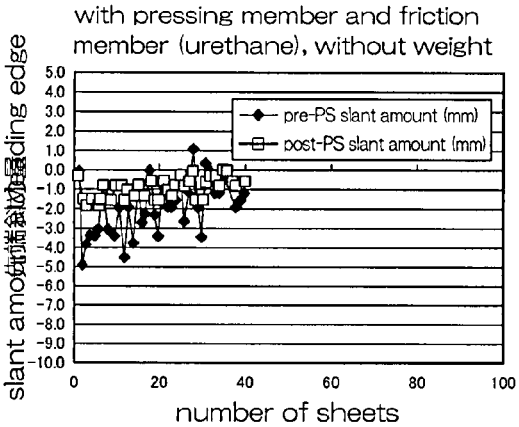

FIG. 10D is a graph showing the measurement results of the pre-PS slant amount and post-PS slant amount obtained with the original pressing member 21 attached, and only the friction member 24 added and the weight 25 omitted.

Figure 10E:
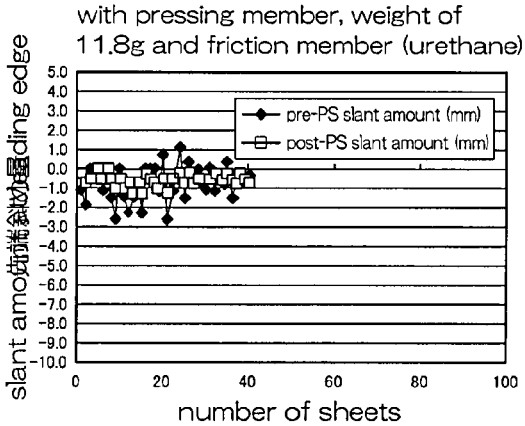

FIG. 10E is a graph showing the measurement results of the pre-PS slant amount and post-PS slant amount obtained with the original pressing member 21 attached, and the friction member 24 and the weight 25 added.

As clearly observed by comparing the graphs in FIGS. 10A to 10E, the slant amount of the original decreased when the original pressing member 21 was attached. The slant amount of the original decreased more in the cases where the friction member 24 or the weight 25 was added than in the case without the friction member 24 and the weight 25. More specifically, although in a state in which the original pressing member 21 was removed, the post-PS slant amount was about 6 mm at maximum (see the graph in FIG. 10A), and the post-PS slant amount was suppressed to about 3 mm with the original pressing member 21 attached and the friction member 24 and the weight 25 omitted (see the graph in FIG. 10B). Further, with the original pressing member 21 attached and the friction member 24 and the weight 25 added, the post-PS slant amount was suppressed to not more than 2 mm (about 1.5 mm) (see the graph in FIG. 10E).

Embodiment 2

Figure 11:
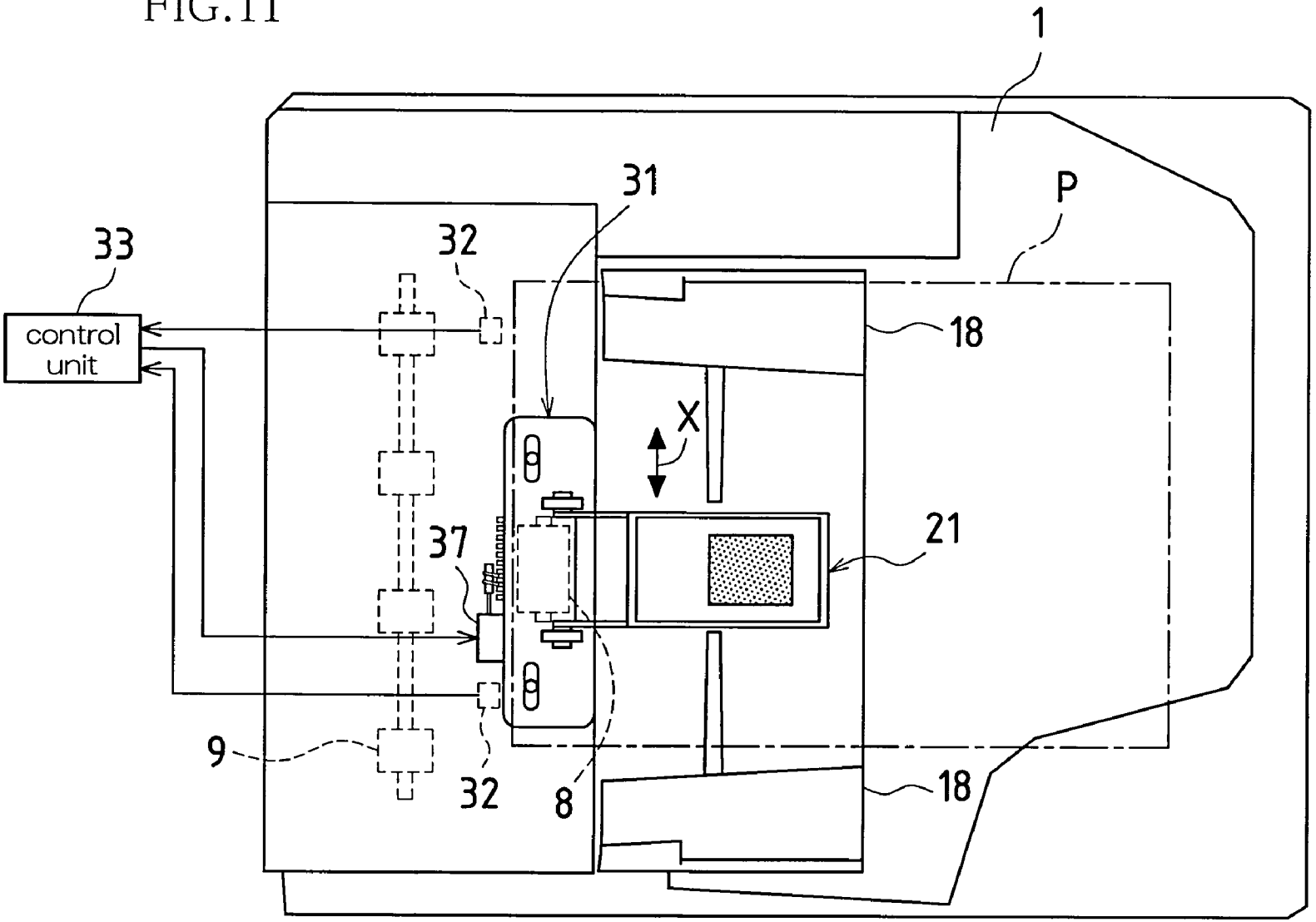
FIG. 11 is a top view showing an original feeding device according to Embodiment 2 of the present invention.

FIG. 11 is a top view showing an original feeding device according to Embodiment 2 of the present invention. In FIG. 11, portions that perform the same functions as the devices shown in FIGS. 1 and 2 are assigned with the same reference numerals as in FIGS. 1 and 2.

In the original feeding device of the present embodiment, a moving mechanism 31 that moves an original pressing member 21 in a direction perpendicular to the original forwarding direction, and a pair of slant sensors 32 that detect the slant amount of an original and the slant transport direction are provided on both sides of the drawing roller 8. A control unit 33 controls driving of the moving mechanism 31 based on the slant amount of the original and the slant transport direction detected by the slant sensors 32, and moves the original pressing member 21 in a direction perpendicular to the original forwarding direction as appropriate so as to constantly suppress slanted transport of the original in a precise manner.

Figure 12:
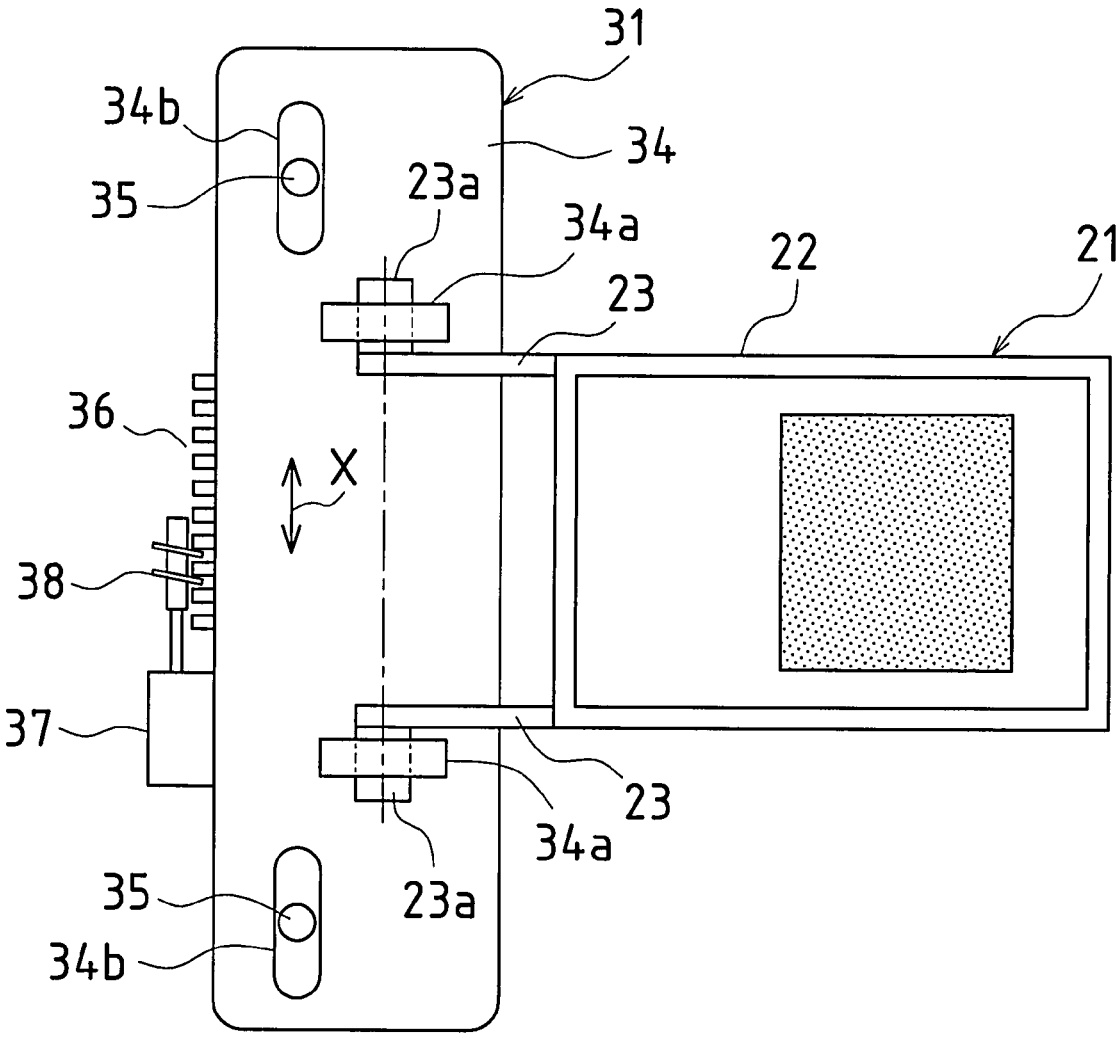
FIG. 12 is a top view enlarging the mechanism around the original pressing member in the device of FIG. 11.

As illustrated in FIG. 12, in the moving mechanism 31, a pair of protrusion pieces 34*a* are provided on an supporting plate 34. The shaft portions 23*a* of the arms 23 of the original pressing member 21 are joined into openings of the protrusion pieces 34*a*, so that the original pressing member 21 is supported such that it can rotate around the shaft portions 23*a* of the arms 23 of the original pressing member 21.

A pair of long axis openings 34*b* that are elongated in a direction perpendicular to the original forwarding direction are formed in the supporting plate 34, and a pair of supporting shafts 35 of the original feeding device main body are joined into these long axis openings 34*a*. Accordingly, the supporting plate 34 and the original pressing member 21 are supported such that they can move in the direction X that is perpendicular to the original forwarding direction.

Further, a rack gear 36 is fixed to one side of the supporting plate 34, a stepping motor 37 is fixed to the original feeding device main body side, and a worm gear 38 fixed to an output shaft of the stepping motor 37 is engaged with the rack gear 36. The control unit 33 controls driving of the stepping motor 37 and control the rotational angle of the worm gear 38, and thereby moves the rack gear 36 in the direction X perpendicular to the original forwarding direction and changes the position in the direction X of the supporting plate 34 and the original pressing member 21, so as to adjust the position at which the original pressing member 21 presses the original in the direction X.

The slant sensors 32 are optical reflective or optical transmissive sensors and detect the leading edge of an original. Since the forwarding speed of the original is constant, time lag in the detection of the leading edge of the original by the slant sensors 32 corresponds to the slant amount of the original and the slant transport direction. The control unit 33 detects the slant amount of the original and the slant transport direction based on the time lag in detection of the leading edge of original by the slant sensors 32.

Figure 13:
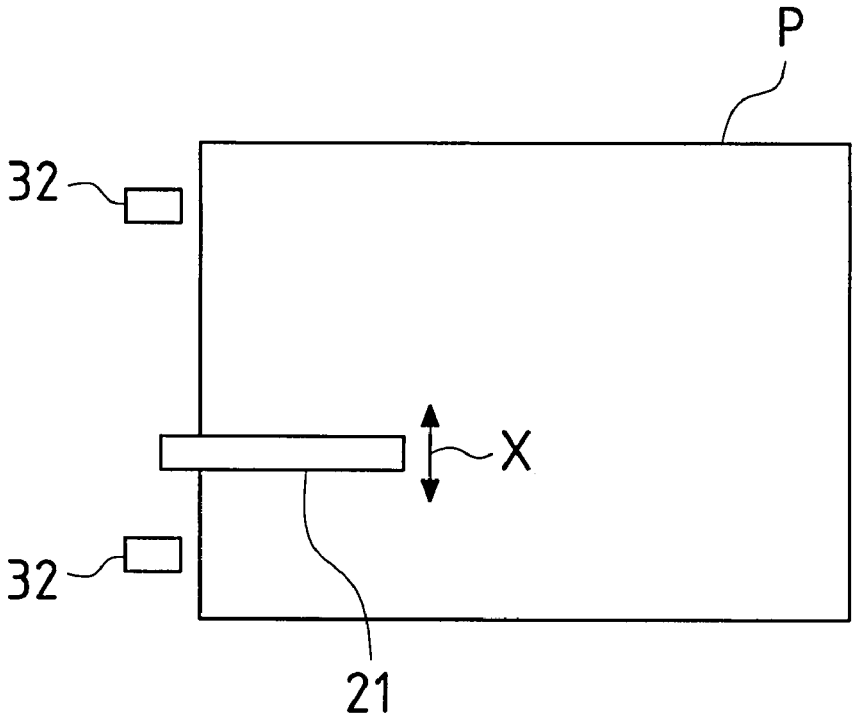
FIG. 13 is a diagram for explaining the control by the device of FIG. 11.

When the slant amount of the original detected by the slant sensors 32 is not less than a certain amount, the control unit 33 lifts up the drawing roller 8 and the original pressing member 21 to separate the original pressing member 21 from the original on an original tray 1. In such a state, the control unit 33 controls driving of the moving mechanism 31 and moves the original pressing member 21 in the direction X as appropriate in accordance with the slant amount of the original and the slant transport direction detected by the slant sensors 32 as shown in FIG. 13. Thereafter, the drawing roller 8 and the original pressing member 21 are lowered down, causing the original pressing member 21 to press the original on the original tray 1. In this way, slanted transport of the original is always suppressed in a precise manner.

The drawing roller 8 and the original pressing member 21 are lifted up/lowered down by controlling driving of a motor of a driving mechanism (not shown).

Figure 14:
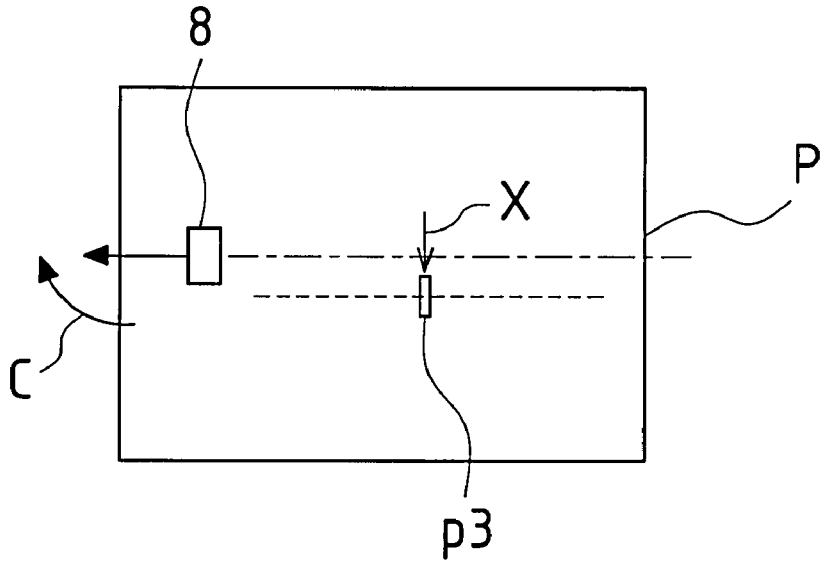
FIG. 14 is a diagram for explaining effects of the device of FIG. 11.

For example, when the original P is slanted in the direction of arrow C, as shown in FIG. 14, the original P is subject to a larger transport force on the lower side of the drawing roller 8 than on the upper side. Therefore, the pressing member 21 (pressing position p3) is moved to the lower side in the direction X concurrently with adjusting the moving distance in accordance with the slant amount, so that precise frictional force (braking force) at the pressing position p3 for resisting the larger transport force is provided to the original P, thereby preventing slanted transport of the original P. Alternatively, the pressing member 21 (pressing position p3) is shifted to the lower side in the direction X so that the moment of the original centering on the pressing member 21 is generated in a direction opposite to the moment of the original causing slanted transport in the direction of arrow C and cancels the moment of the original that causes the slanted transport, thereby preventing slanted transport of the original.

Slanted transport of the original P occurs when the drawing force of the drawing roller 8 is applied to a position displaced from the center line p1 of the original P, or when a pressure F of the drawing roller 8 that acts on the original P is shifted to the right or left. However, in both of these cases, slanted transport of the original P can be prevented in a precise manner by moving the pressing member 21 (pressing position p3) in the direction X and adjusting the moving distance in accordance with the slant amount.

Figure 15:
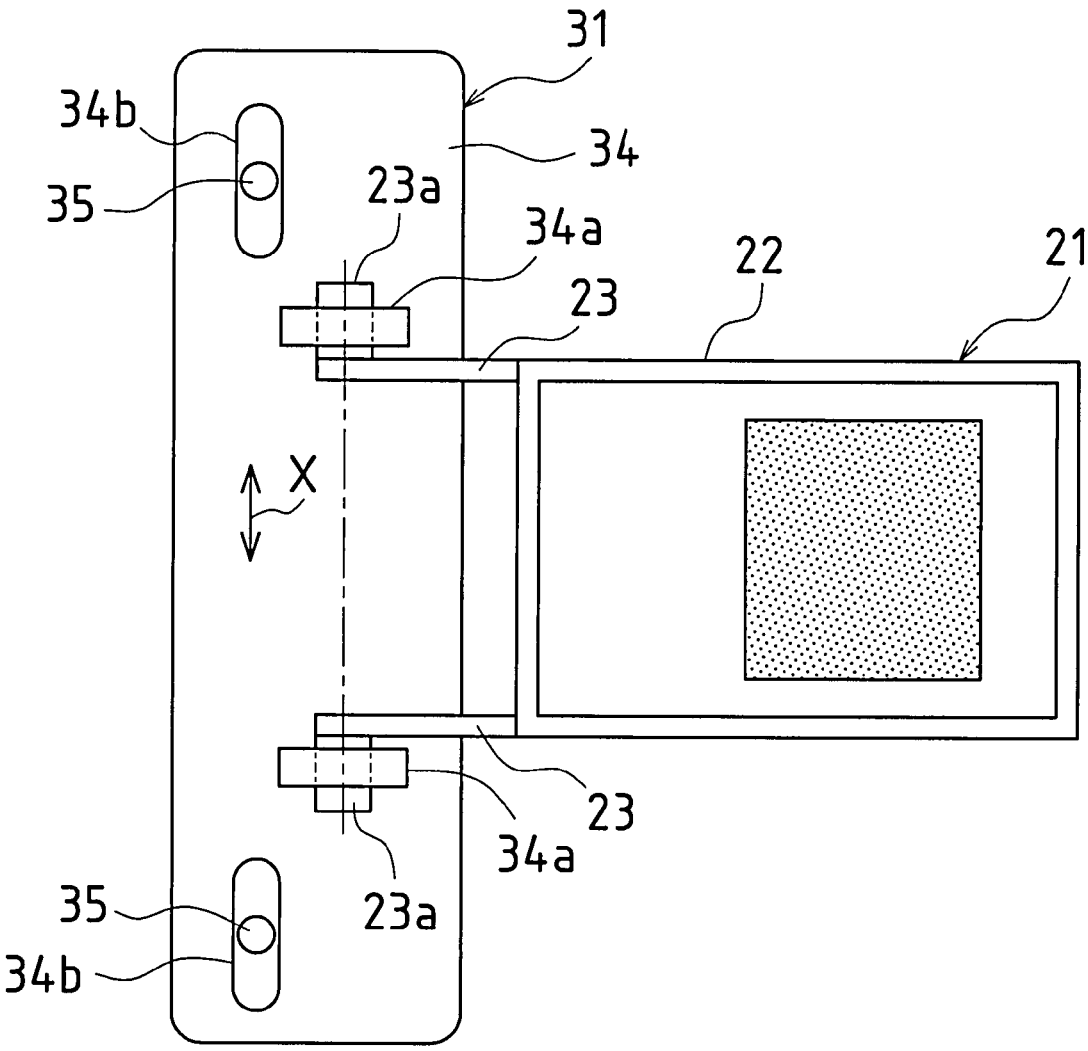
FIG. 15 is a top view showing a modified example of the device of FIG. 11.
Figure 16:
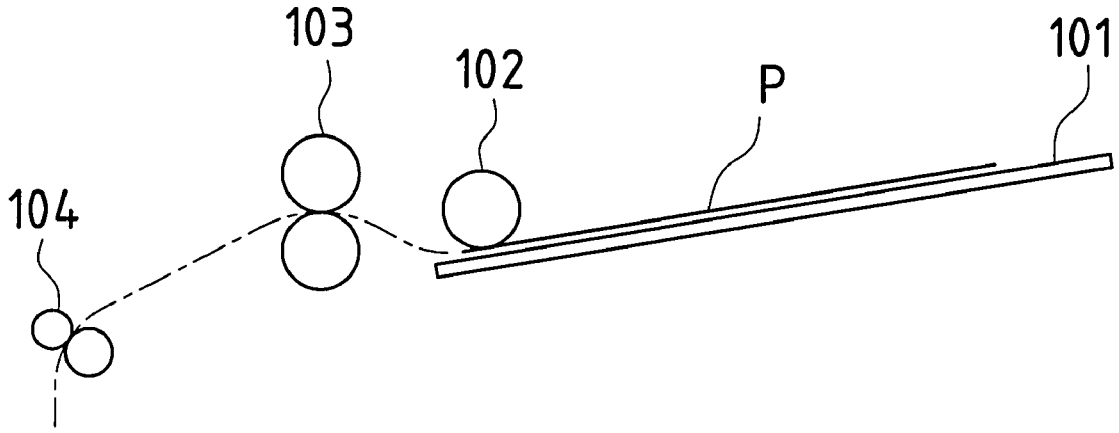
FIG.16 Prior Art
FIG. 16 is a lateral view schematically showing a conventional device.
Figure 17:
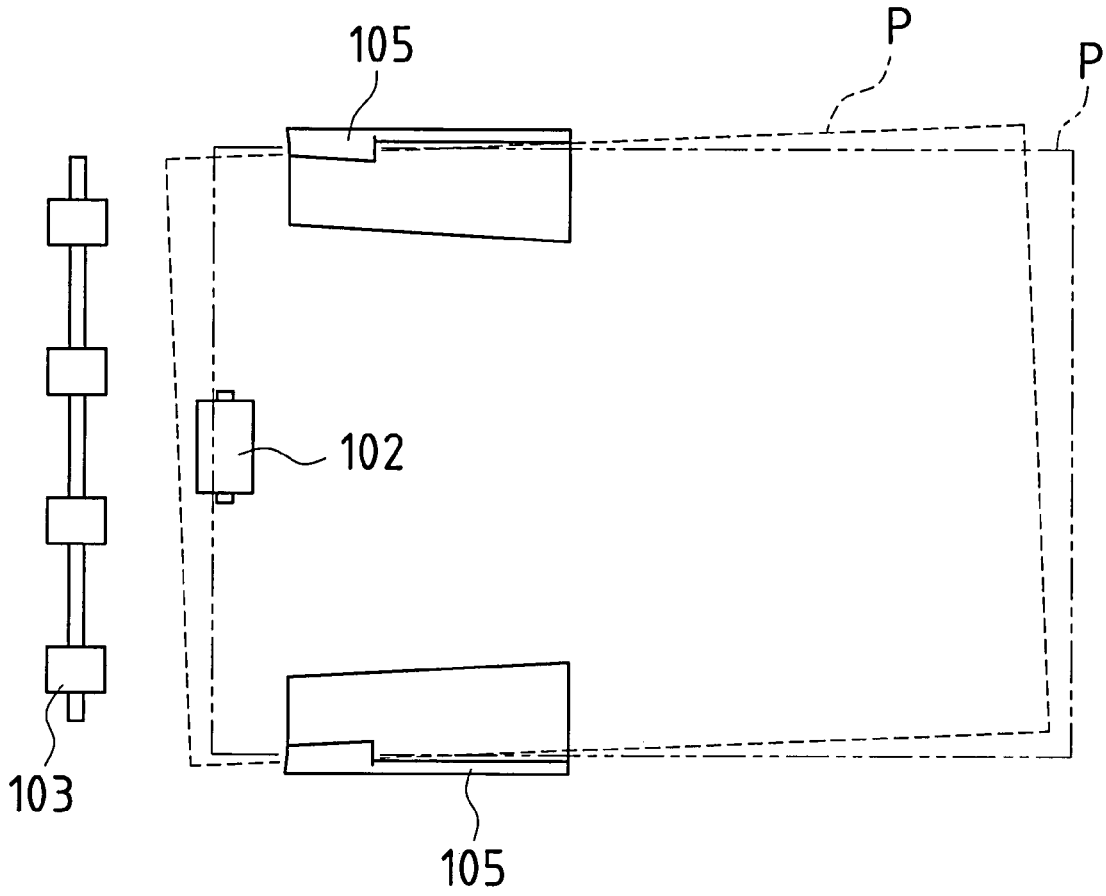
FIG.17 Prior Art
FIG. 17 is a top view schematically showing the conventional device of FIG. 16.

In the foregoing embodiments, the slant amount of the original and the slant transport direction are detected by the slant sensors 32, and the original pressing member 21 is moved in the direction X based on the detected slant amount of the original and slant transport direction. However, it is possible that the user determines the slant amount of the original and the slant transport direction, and manually moves the original pressing member 21. In such a case, as illustrated in FIG. 15, the control unit 33, the rack gear 36, the stepping motor 37, the pinion gear 38 or the like can be omitted.

Also, the present invention is not limited to the foregoing embodiments, and can be modified in various manners. For example, the shape, size or the like of the original pressing member may be modified as appropriate. The base shape of the original pressing member may be modified to appropriately change the shape or size of the region in which frictional force is generated between the original pressing member and the original.

The present invention may be embodied in various other forms without departing from the gist or essential characteristics thereof. The embodiments disclosed in this application are to be considered in all respects as illustrative and not limiting. The scope of the invention is indicated by the appended claims rather than by the foregoing description, and all modifications or changes that come within the meaning and range of equivalency of the claims are intended to be embraced therein.

What is claimed is:

1. An original feeding device comprising:

a drawing roller, which contacts and draws out an original from an original tray for forwarding by rotating the drawing roller, an original pressing member at a location on the side further upstream in a forwarding direction of the original than the drawing roller, in such a manner as to apply frictional force to a surface of the original which is forwarded by the drawing roller, a moving means for moving, in a direction perpendicular to the forwarding direction of the original, a pressing position where the original pressing member presses on the original surface, a slanted transport detecting means for detecting slanted transport of the original forwarded by the drawing roller, and a control unit that moves and adjusts the pressing position where the original pressing member presses on the original surface with the moving means when the slanted transport detecting means detects slanted transport of the original.

2. The original feeding device according to claim 1, wherein the original pressing member comprises a weight for pressing the original surface.

3. The original feeding device according to claim 1, wherein the original pressing member comprises a friction member that contacts the original surface and generates frictional force.

4. The original feeding device according to claim 1, comprising a lifting mechanism for lifting up/lowering down the drawing roller with respect to the original, wherein the lifting mechanism lifts up/lowers down the original pressing member in conjunction with lifting up/lowering down of the drawing roller, and the original is pressed against or released from such pressing by the original pressing member.

5. The original feeding device according to claim 1, wherein the original pressing member can move in a direction perpendicular to the forwarding direction of the original.

6. The original feeding device according to claim 1 comprising:

a separating roller for separating originals forwarded by the drawing roller one by one, wherein the distance from the pressing position where the original pressing member presses on the original surface to the trailing edge of a smallest size original which is fed and forwarded in the original feeding device is longer than the distance from the drawing roller to the separating roller.

* * * * *